US005329776A

United States Patent [19]

Grenier

[11] Patent Number: 5,329,776

[45] Date of Patent: Jul. 19, 1994

[54] PROCESS AND APPARATUS FOR THE PRODUCTION OF GASEOUS OXYGEN UNDER PRESSURE

[75] Inventor: Maurice Grenier, Paris, France

[73] Assignee: L'Air Liquide, Societe Anonyme Pour L'Etude et L'Exploitation Des Procedes Georges Claude, Paris, France

[21] Appl. No.: 153,794

[22] Filed: Nov. 17, 1993

Related U.S. Application Data

[63] Continuation of Ser. No. 848,243, Mar. 9, 1992.

[30] Foreign Application Priority Data

Mar. 11, 1991 [FR] France ..... 91 02917
Dec. 20, 1991 [FR] France ..... 91 15935

[51] Int. Cl.[5] ..... F25J 3/02

[52] U.S. Cl. ..... 62/24; 62/25; 62/38; 62/41

[58] Field of Search ..... 62/24, 25, 38, 41

[56] References Cited

U.S. PATENT DOCUMENTS 3,447,332 6/1969 Basin et al. ..... 62/41 X
3,648,471 3/1972 Basin et al. .
3,760,596 9/1973 Basin et al. ..... 62/41 X
4,224,045 9/1980 Olszewski et al. ..... 62/38 X
4,303,428 12/1981 Vandenbussche .
4,555,256 11/1985 Skolaude et al. ..... 62/25 X
4,746,343 5/1988 Ishizu et al. ..... 62/38
4,817,394 4/1989 Erickson ..... 62/38 X
5,037,462 8/1991 Schweigert ..... 62/38 X
5,080,703 1/1992 Rathbone ..... 62/38
5,092,132 3/1992 Marshall et al. ..... 62/24
5,098,456 3/1992 Dray et al. ..... 62/24
5,148,680 9/1992 Dray ..... 62/24
5,157,926 10/1992 Guilleminot et al. ..... 62/38 X

FOREIGN PATENT DOCUMENTS 0042676 12/1980 European Pat. Off. .
0024962 3/1981 European Pat. Off. .
929798 6/1963 United Kingdom .

*Primary Examiner*—Henry A. Bennett
*Assistant Examiner*—Christopher B. Kilner
*Attorney, Agent, or Firm*—Curtis, Morris & Safford

[57] ABSTRACT

In this process for the production of gaseous oxygen under pressure by air distillation in a double column, pumping liquid oxygen withdrawn at the bottom of the low pressure column, and vaporization of compressed liquid oxygen by heat exchange with air at high pressure, all the air to be distilled is compressed at the high air pressure, followed by expanding, at the pressure of the mean pressure column, the excess fraction of this air in a turbine which is decelerated by means of an air booster, and at least one liquid product is withdrawn from the apparatus.

15 Claims, 6 Drawing Sheets

PROCESS AND APPARATUS FOR THE PRODUCTION OF GASEOUS OXYGEN UNDER PRESSURE

This application is a continuation of application Ser. No. 07/848,243, filed Mar. 9, 1992.

BACKGROUND OF THE INVENTION

Field of the Invention

This invention relates to a process and an apparatus for the production of gaseous oxygen at high pressure by distillation or air in a double column apparatus comprising a low pressure column and a mean pressure column. The process includes pumping of liquid oxygen withdrawn at the bottom of the low pressure column, and vaporization of the liquid oxygen which is compressed by heat exchange, in a heat exchange line, with air brought to high pressure which is substantially higher than the pressure of the mean pressure column.

The pressures which are maintained below are absolute pressures. The pressures of the mean pressure column and of the low pressure column will hereinafter be called "mean pressure" and "low pressure" respectively.

Processes of this type, known as "pump" processes, render gaseous oxygen compressors unnecessary. To reduce energy expenditure, it is necessary to vaporize a considerable amount of oxygen, of the order of 1.5 times the flow of oxygen to be vaporized, until the pressure achieved is sufficient to liquefy compressed air in counter-current heat exchange.

It is known that the energy expenditure of apparatuses of this type is only lower or equal to that of the apparatuses provided with an oxygen compressor for oxygen vaporization pressures lower than about 10 bars. This energy expenditure progressively increases with pressure. Moreover, in applications where the energy expenditure is acceptable, the usual technology utilizes two compressors mounted in series, the second one treating only the fraction of air intended to vaporize liquid oxygen, which considerably increases the cost of the apparatus.

SUMMARY OF INVENTION

The invention aims at providing a reduced cost "pump" process.

For this purpose, the process according to the invention is characterized in that: all the air to be distilled is compressed to a high pressure; at an intermediate cooling temperature, the fraction of this air which is surplus to the refrigerating needs of the heat exchange line is expanded in a turbine which is decelerated by means of an air booster, at the pressure of the mean pressure column; and at least one liquid product is withdrawn from the apparatus.

Where the oxygen is lower than about 13 bars, the air pressure selected is the air condensation pressure by heat exchange with oxygen during vaporization under the high oxygen pressure;

Provided the oxygen pressure is higher than about 13 bars, the air pressure is selected to be lower than the air condensation pressure by heat exchange with the oxygen during vaporization under the high oxygen pressure, and is at least equal to about 30 bars.

It is also an object of the invention to provide an apparatus for the production of gaseous oxygen under pressure, according to the process described. This apparatus, of the type comprising a double column for the distillation of air comprising a low pressure column and a mean pressure column, a pump for compressing liquid oxygen which is withdrawn at the bottom of the low pressure column, means for compressing air to bring a fraction of the air to be distilled to high pressure, and a heat exchange line to bring said air fraction into heat exchange relationship with the compressed liquid oxygen, is characterized in that said means for compressing air are mounted so as to treat all air to be distilled, and in that the apparatus comprises an expansion turbine decelerated by means of an air booster and whose suction side is connected to ducts for cooling air, at an intermediate point of the heat exchange line, the exhaust from this turbine being directly connected to the mean pressure column, and means for withdrawing at least one liquid product from the apparatus.

An in depth study of the phenomena which takes place in the process defined above shows that, in certain cases, the expansion turbine may cause some liquid to be formed at the inlet of its rotor if it is intended to maintain reduced temperature gaps at the location where vaporization of oxygen takes place, and at the hot end of the exchange line. This is the case where the pressure of oxygen is higher than approximately 13 bars, where the apparatus comprises a single expansion turbine (i.e. has no turbine for the expansion of air at low pressure) and nearly all liquid oxygen withdrawn from the double column is vaporized under pressure.

In a further embodiment of the invention, the small temperature gaps mentioned above, and thus low energy expenditure are achieved while preventing the production of liquid at the inlet of the rotor of the expansion turbine.

For this purpose, it is an object of the invention to provide a further process of the type mentioned above, characterized in that:

all the air to be distilled is compressed to a first high pressure considerably higher than the mean pressure;

a first fraction of this air is cooled at the first elevated pressure and, at an intermediate cooling temperature, at least a portion thereof is expanded at mean pressure in a turbine before introducing it into the double column;

the remaining air at the first high pressure is boosted to a second high pressure, at least a portion of the boosted air, the volume of which is lower than the volume of liquid oxygen to be vaporized, being cooled and liquefied and, after expansion, is then introduced into the double column;

the second elevated pressure is on the one hand lower than the air condensation pressure or pseudo-condensation pressure by heat exchange with oxygen during vaporization at high pressure and at least equal to about 30 bars, and is on the other hand, selected so that the condensation or the pseudo-condensation of air under this second elevated pressure takes place at about the inlet temperature of the turbine; and at least one liquid product is withdrawn from the apparatus.

It is also an object of the invention to provide a further apparatus for carrying out this further process. This apparatus, of the type comprising a double column for the distillation of air comprising a low pressure column and a mean pressure column, a pump for compressing liquid oxygen withdrawn at the bottom of the low pressure column, compressing means to pressurize the air to be distilled to a pressure considerably higher than the mean pressure, and a heat exchange line to place the air at high pressure in heat exchange relationship with the compressed liquid oxygen, is characterized in that the compressing means comprise a compressor to pressurize all the air to be distilled to a first high pressure which is considerably higher than the pressure of the mean pressure column, and means for boosting a fraction of the air under this elevated pressure, these boosting means comprising first and second blowers mounted in series, and each connected to an expansion turbine, the first blower being connected to a turbine for expanding air at the first high pressure and the second blower being connected to a second turbine for expanding a portion of the boosted air, the inlet temperature of the second turbine being higher than that of the first turbine, the apparatus also comprising means for withdrawing at least one liquid product from the apparatus.

BRIEF DESCRIPTION OF DRAWINGS

Embodiments of the invention will now be described with reference to the annexed drawings, in which.

DESCRIPTION OF PREFERRED EMBODIMENTS

Figure 1:
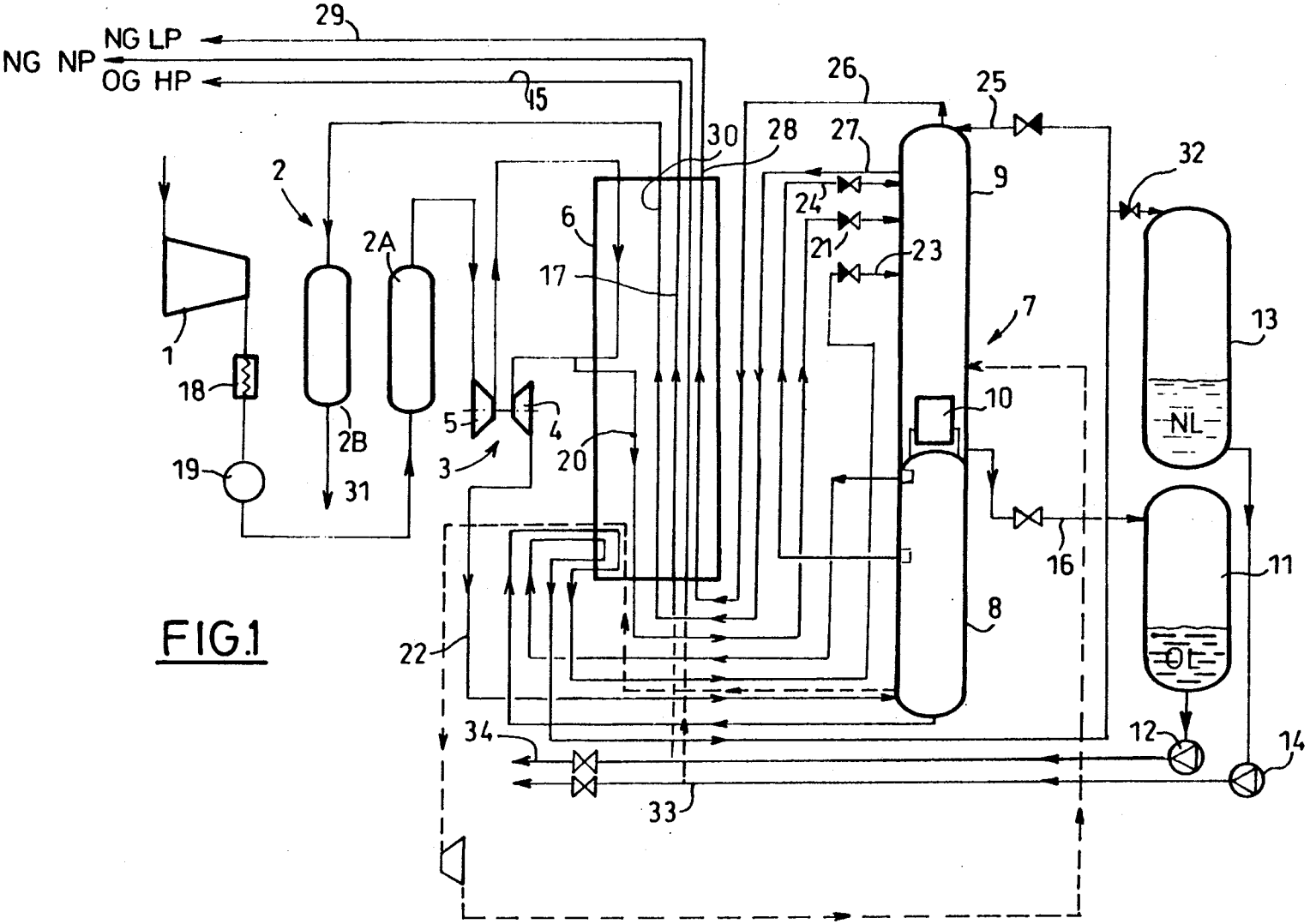
FIG. 1 is a schematic illustration of an apparatus for the production of gaseous oxygen according to the invention.

The air distillation apparatus illustrated in FIG. 1 essentially comprises: an air compressor 1; and apparatus 2 for withdrawing water and $CO_2$ from compressed air by adsorption, this apparatus comprising two adsorption bottles 2A, 2B, one operating by adsorption while the other is regenerated; a turbine-booster unit 3 comprising an expansion turbine 4 and a booster 5 whose shafts are connected together; a heat exchange 6 defining the heat exchange line of the apparatus; a double distillation column 7 comprising a mean pressure column 8 underneath a low pressure column 9, with a vaporizer-condenser 10 which permits heat exchange between the head vapor (nitrogen) of column 8 and the liquid (oxygen) at the bottom of column 9; a container for liquid oxygen 11 whose bottom is connected to a pump for liquid oxygen 12; and a liquid nitrogen container 13 whose bottom is connected to a pump for liquid nitrogen 14.

This apparatus is intended to supply, via duct 15, gaseous oxygen at a predetermined elevated pressure, which may be between a few bars and a few tens of bars (in the present description, the pressures under consideration are absolute pressures).

To do this, liquid oxygen withdrawn from the bottom of column 9 via a duct 16 is stored in container 11, and is pressurized by pump 12, then vaporized and reheated under this elevated pressure in duct 17 of the exchanger 6.

The required heat for this vaporization and reheating, as well as for the reheating and possibly the vaporization of other fluids which are withdrawn from the double column, is supplied by the air to be distilled, under the following conditions.

All the air to be distilled is compressed in compressor 1 at a pressure higher than the mean pressure of column 8 but lower than the elevated pressure. Then, the air, which is pre-cooled at 18 and cooled at about room temperature at 19, is purified in one of the adsorption bottles, for example, 2A, and entirely boosted to a high pressure through booster 5, which is operated by the turbine 4.

The air is then introduced at the hot end of the exchanger 6 and is entirely cooled until reaching an intermediate temperature. At this temperature, a fraction of the air continues to be cooled and is liquefied in ducts 20 of the exchanger, after which it is expanded at low pressure in an expansion valve 21 and is introduced at an intermediate level of column 9. The remaining air, or excess air, is expanded at mean pressure in turbine 4, after which it is sent directly, via duct 22, to the base of the column 8.

The usual ducts of the double column apparatuses are shown in FIG. 1, the apparatus which is illustrated being of the so-called "minaret" type, i.e. with production of nitrogen under low pressure. The ducts 23 to 25 inject, into column 9, at increasing levels, "rich liquid" (oxygen enriched air), expanded "inferior poor liquid" (impure nitrogen) and expanded "superior poor liquid" (nearly pure nitrogen), respectively, these three fluids being respectively withdrawn at the base, at an intermediate point and at the top of column 8. The ducts 26 and 27 are respectively for withdrawing gaseous nitrogen from the top of column 9 and withdrawing residual gas (impure nitrogen) from the level of injection of inferior poor liquid. The low pressure nitrogen is warmed in ducts 28 of the exchanger 6 and is withdrawn via duct 29, while the residual gas, after reheating in ducts 30 of the exchanger, is used to regenerate an adsorption bottle, in the example under consideration, before being withdrawn via duct 31.

It will also be seen with reference to FIG. 1 that a portion of the mean pressure liquid nitrogen, after expansion in an expansion valve 32, is stored in container 13, and that a supply of liquid nitrogen and/or liquid oxygen is supplied via duct 33 (in the case of nitrogen) and/or 34 (in the case of oxygen).

As regards the choice of the pressure of boosted air, there are two situations to consider.

Figure 2:
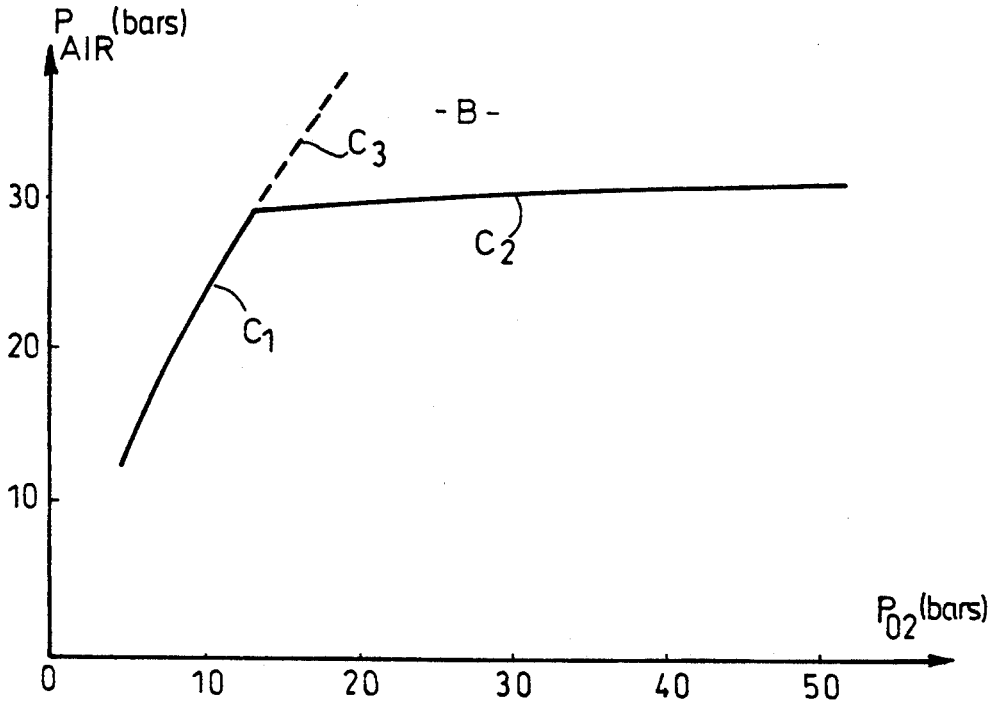
FIG. 2 is a diagram showing how the vaporization pressure of oxygen, according to the invention, varies as a function of the oxygen pressure.
Figure 3:
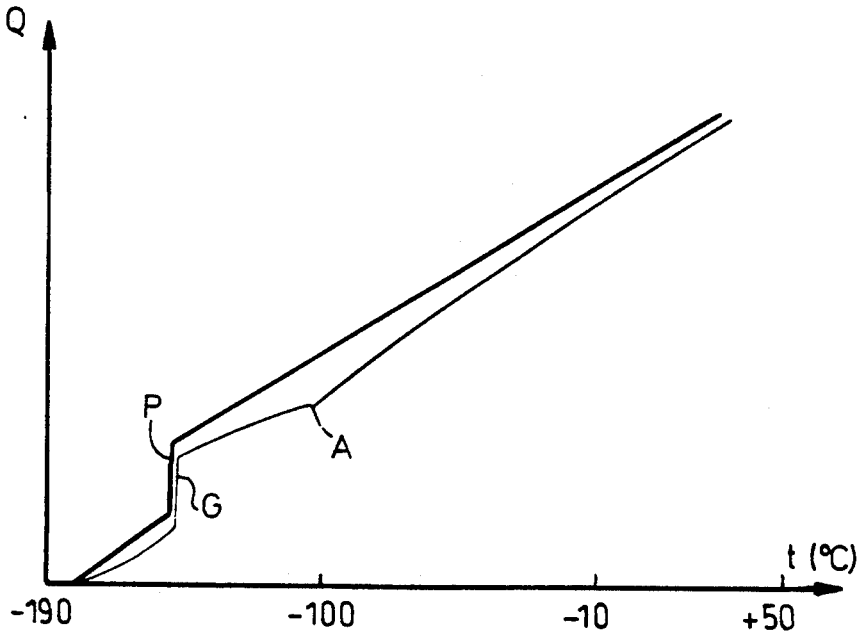
FIGS. 3 to 5 are heat exchange diagrams corresponding to three different uses of the apparatus according to the invention.

When the oxygen pressure is lower than about 13 bars, this air pressure is the air condensation pressure by heat exchange with oxygen during vaporization under elevated pressure, i.e. the pressure for which air liquefaction 'knee' G, on the heat exchange diagram (temperature in abscissae, quantities of heat exchanged in ordinates) is located slightly to the right of the oxygen vaporization vertical plateau P at high pressure (FIG. 3). The temperature gap at the hot end of the exchange line is adjusted by means of the turbine, whose suction temperature is indicated at A. The irreversibility of the heat exchange is thus at a minimum. The air pressure is shown as a function of the high pressure, on the left portion C1 of the curve of FIG. 2.

As seen in FIG. 2, an oxygen pressure of the order of 13 bars corresponds to an air pressure of the order of 30 bars (more specifically, approximately 28.5 bars). For any oxygen pressure is higher than 13 bars, an air pressure of the order of 30 bars is selected, as indicated in the straight portion C2 of the curve of FIG. 2.

In the first case (oxygen pressure lower than approximately 13 bars) the production of oxygen and/or nitrogen, in liquid form results in a deficit of cold gaseous products in the exchanger 6, and consequently a relatively a relatively high suction temperature in turbine 4. The consequence of this phenomenon is substantial refrigeration by this turbine, which enables the apparatus to produce a considerable amount of oxygen and/or nitrogen in liquid form, economically.

Figure 4:
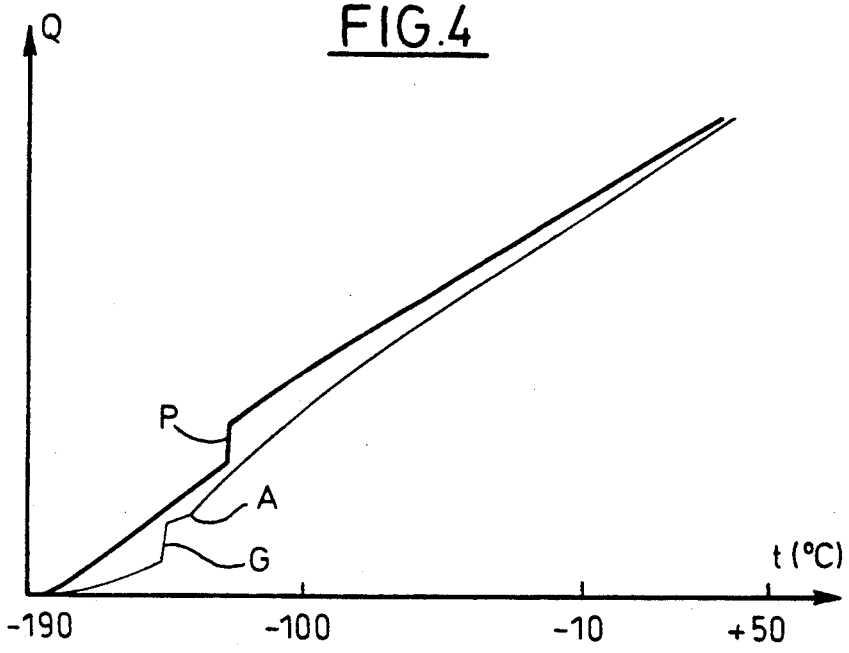

In the second case (oxygen pressure higher than approximately 13 bars), with reference to FIG. 2, the air pressure is no longer found at the extension C3 of curve C1; consequently, the liquefaction 'knee' G (FIG. 4) is displaced towards the left with respect to the oxygen vaporization plateau P, and the suction temperature of the turbine becomes lower than that of plateau P. As a result, a substantial fraction of the turbined air is at a mean pressure in liquid form, and the refrigerating output of the apparatus is balanced, with a temperature gap at the hot end of the order of 3° C., by withdrawing from the apparatus at least one product (oxygen and/or nitrogen) in liquid form via ducts 33 and/or 34. When the air pressure is of the order of 30 bars, this equilibrium is obtained for a liquid withdrawal of the order of 25% of the production at gaseous oxygen at high pressure.

As a variant, air pressure between approximately 30 bars and curve C3, may be selected, i.e., in region B of FIG. 2. A larger quantity of liquid must then be withdrawn to reach equilibrium.

Thus, over the entire range of oxygen pressures, apparatus with a single compressor is used, which reduces costs and the "wasted" energy resulting from the compression of all the air at the oxygen vaporization pressure is used to produce a liquid.

In a variant which is not illustrated, within pressure and flow ranges which can easily be determined by calculation, gaseous nitrogen under pressure may, additionally, be produced in a similar manner, by bringing liquid nitrogen to desired pressure, by withdrawal at the top of column 8 or by means of a pump such as 14 which sucks liquid nitrogen at this location or from container 13, and by leaving this liquid nitrogen in appropriate vaporization-reheating ducts of the exchanger 6.

Figure 5:
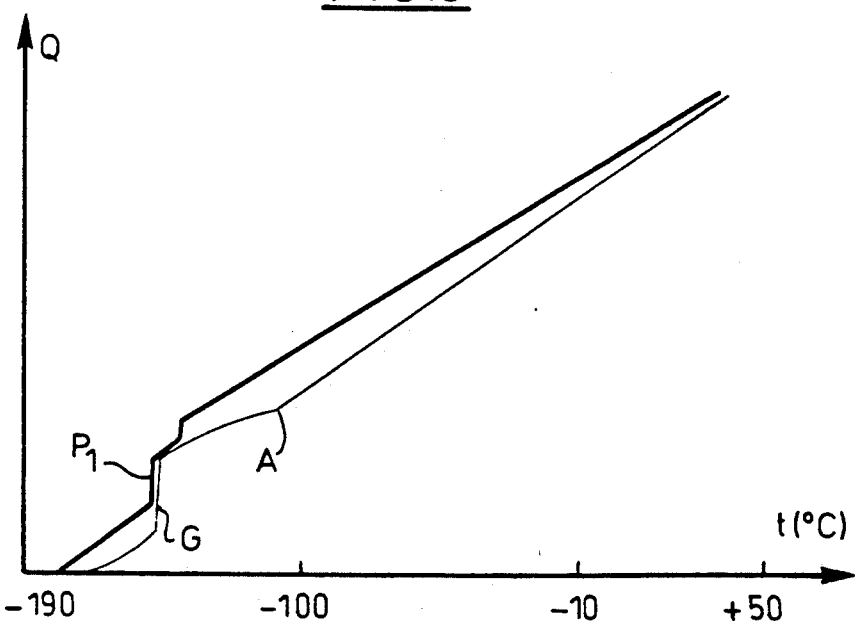

According to another variant, illustrated only in the heat exchange diagram of FIG. 5, part of the gaseous oxygen produced may be at a different high pressure, by vaporizing same under this pressure in other appropriate ducts of the exchanger 6. If one of the two high pressures is lower than approximately 13 bars and the other is higher than approximately 13 bars, all the air is preferably compressed at approximately 30 bars (or above as explained above), and in any case so that the liquefaction knee G is opposite the vaporization plateau P1 for oxygen at the lower elevated pressure, and the suction temperature of the turbine (point A) is higher than that of oxygen vaporization plateau P2 at the higher pressure. In this case the heat exchange diagram is well confined, and which has advantages from an energy point of view.

According to still another variant, if the oxygen produced is of low purity (of the order of 90 to 98%) there may be provided a second turbine (not illustrated) which expands from mean pressure to low pressure, a fraction, about 10 to 25%, of the flow of air being treated, the low pressure air thus obtained being blown into column 9. If the oxygen pressure is lower than approximately 13 bars, this fraction may be taken from the exhaust of turbine 4, whose temperature is sufficiently high. Otherwise, said fraction is taken at the bottom of column 8 (as shown in broken lines in FIG. 1) or taken from the exhaust of turbine 4, separated from its liquid phase, and reheated before being expanded.

This variant allows increased liquid production while slightly decreasing the production of mean pressure liquid, and consequently the operating pressure of the apparatus, i.e. the high air pressure.

Figure 6:
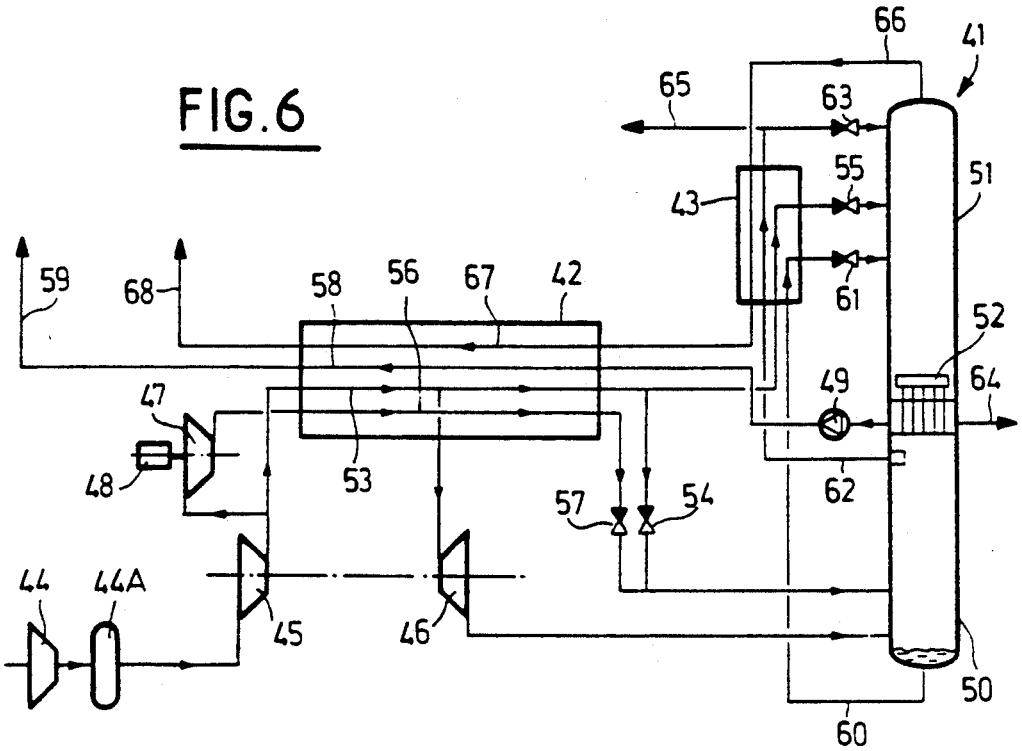
FIG. 6 is a schematic illustration of another apparatus for the production of gaseous oxygen according to the invention.

The apparatus illustrated in FIG. 6 is intended to produce gaseous oxygen under a pressure at least equal to approximately 13 bars and, in this example, 35 bars. It essentially comprises a double distillation column 41, a main heat exchange line 42, a sub-cooler 43, a single air compressor 44, a blower 45 for boosting air, an expansion turbine 46 in which the rotor is mounted on the same shaft as that of the booster 45, an additional blower 47 driven by electrical motor 48, and a pump for liquid oxygen 49. The double column consists, in known manner, of a mean pressure column 50 operating under about 6 bars and surmounted by a low pressure column 51 operating slightly above atmospheric pressure, with, at the bottom of the latter, a vaporizer-condenser 52 which places liquid oxygen from the bottom of the low pressure column in heat exchange relationship with nitrogen at the top of the mean pressure column. In operation, all of the air to be distilled, is compressed by means of compressor 44 at a pressure of approximately 23 bars and is purified in an adsorber 44A, is boosted by booster 45 to a first high pressure of approximately 28 bars, and is thereafter divided into two flows.

The first flow is cooled under this first elevated pressure in ducts 53 of heat exchange line 42. A portion of this first flow continues to be cooled, and is liquefied, until reaching the cold end of the exchange line, after which it is expanded by mean pressure and at low pressure in expansion valves 54 and 55 respectively and distributed between columns 50 and 51. What is left of the first flow exists from the exchange line at an intermediate temperature T1, is expanded in turbine 46 at mean pressure and is introduced at the base of column 50.

The second flow of boosted air is again boosted, up to a second high pressure of about 35 to 40 bars, by means of blower 47, then is cooled and liquefied in ducts 56 of the exchange line, until reaching the cold end of the latter. The liquid thus obtained is expanded in an expansion valve 57 and is sent at the base of column 50.

In the present specification, "booster" or "blower" means a single rotor compressor in which the energy consumption, with respect to the amount of gas treated and the compression rate, is considerably lower than that of the main compressor 44 of the apparatus, for example about 2 to 3 percent of the latter. The rate of compression of such a blower is generally lower than 2. Each blower which is referred to herein includes at its outlet a water or atmospheric air refrigerating unit not illustrated.

The liquid oxygen which is withdrawn at the bottom of column 51 is brought to a desired production pressure by means of pump 49, after which it is vaporized and reheated in ducts 58 of the exchange line before being withdrawn from the apparatus via production duct 59.

On the other hand, FIG. 6 shows that the apparatus is provided with the usual ducts and accessories in the case of double column apparatuses: a duct 60 for raising "rich liquid" (oxygen enriched air) collected at the bottom of column 50 in column 51, with its expansion valve 61, a duct 62 for "poor liquid" (substantially pure nitrogen) withdrawn at the top of column 50, at the top of column 51, with its expansion valve 63, as well as a duct 64 for the production of liquid oxygen, bled at the bottom of column 51, a duct 65 for the production of liquid nitrogen, bled on duct 62, and a duct 66 for withdrawing impure nitrogen, constituting the residual gas of the apparatus, bled at the top of column 51, this impure nitrogen being reheated in sub-cooler 43 then in ducts 67 of the exchange line before being withdrawn via duct 68.

Figure 7:
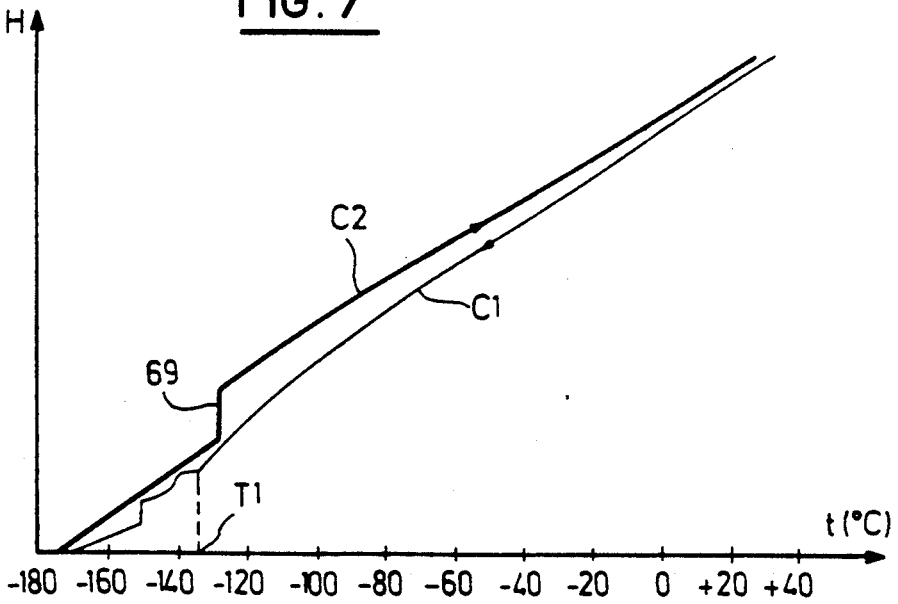
FIG. 7 is a heat exchange diagram corresponding to this apparatus, the temperature in Celsius degrees being given in abscissae and the exchanged enthalpies in the heat exchange line being given in ordinates.

As seen in FIG. 7, the inlet temperature T1 of turbine 46 is lower than the oxygen vaporization temperature of plateau 69 under production pressure, and the refrigerating output of the apparatus is balanced, so as to maintain a small temperature gap at the hot end of the exchange line, by withdrawing via ducts 64 and/or 65 certain quantities of liquid nitrogen and/or liquid oxygen, as explained above with reference to FIGS. 1 to 5. When the pressure of the air which is being compressed by compressor 44 is of the order of 23 bars, this equilibrium is obtained for a withdrawal of liquid of about 5 percent of the amount of air treated.

Moreover, the second high pressure mentioned above is on the one hand lower than the pressure of condensation of the air by heat exchange with the oxygen being vaporized under the production pressure, and on the other hand is selected so that the air which is brought to this second high pressure starts to condense at a temperature near T1. This ensures considerable heat input at the vicinity of this temperature T1 and enables the turbine 46 to operate under good conditions, i.e. without production of liquid at the inlet of its rotor, while maintaining optimum temperature gaps, of the order of 2 to 3° C., at the two ends of the exchange line as well as at the location of the vaporization plateau 69.

It should be noted that the amount of boosted air which is liquefied in ducts 56 is much smaller than that required for the vaporization of oxygen. This amount of liquefied air is indeed lower than the amount of oxygen to be vaporized and is only sufficient to prevent the appearance of liquid at the inlet of the rotor of the turbine 46.

If the parameters of the apparatus are such that the second elevated pressure of the air is super-critical, it is the pseudo-condensation of the air which should take place at about temperature T1.

Figure 8:
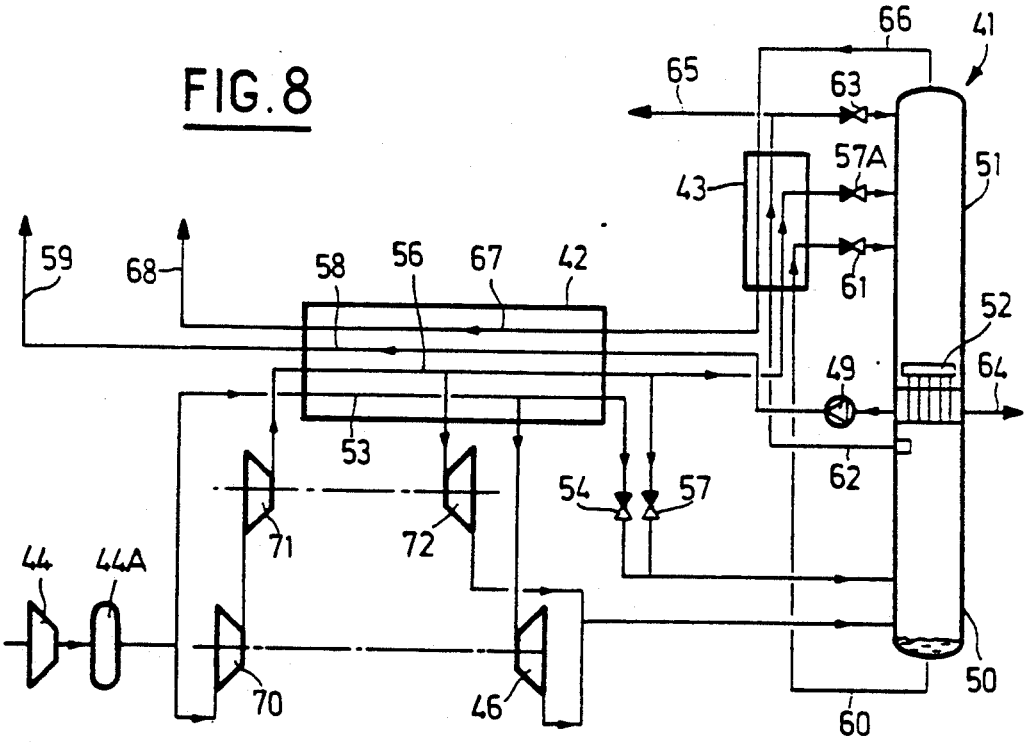
FIGS. 8 and 9 are views respectively similar to FIGS. 6 and 7 but related to another embodiment of the apparatus according to the invention.

In the embodiment of FIG. 8, the air compressor 44 of the apparatus directly compresses all the air at the first high pressure of the order of 23 bars, and a first amount of this air is treated as previously in ducts 53, turbine 46 and expansion valve 54 after which it is sent to the bottom of column 50.

However, the remaining portion of this air is boosted in two stages, by means of two blowers mounted in series. A first blower 70, similarly to blower 45 in FIG. 6, is directly connected to turbine 46, and a second blower 71 is directly coupled to a second expansion turbine 72. The air boosted by blower 70 is passed entirely into blower 71 then into ducts 56 of the exchange line 42, and a portion of this air exists from the exchange line at a temperature T2 higher than temperature T1, to be expanded in turbine 72. The exhaust from the latter, at mean pressure, is connected to the base of column 52 similarly as in the case of turbine 46.

The air at the highest pressure which is not expanded in turbine 72 continues to be cooled and is liquefied in ducts 56 until reaching the cold end of the exchange line, after which it is expanded in expansion valves 57 and 57A and is distributed between the two columns 50 and 51. Valve 57A replaces valve 55 of FIG. 6.

Figure 9:
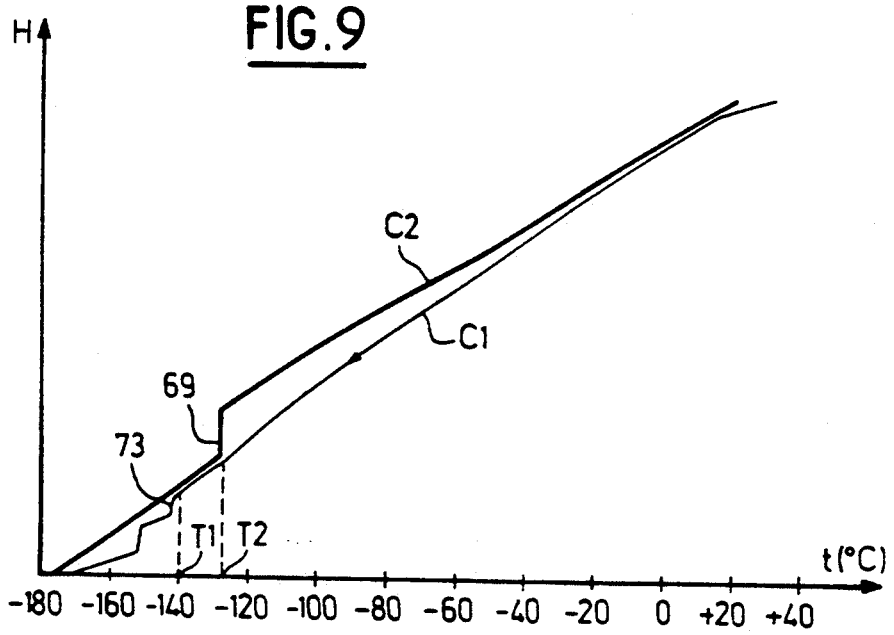

As seen in FIG. 9, the temperature T2 may be selected slightly above the oxygen vaporization plateau 69. In view of the small amount of the expanded air in turbine 72, the air cooling curve is substantially parallel to the reheating curve of the liquid oxygen and of the gaseous nitrogen at temperature T2 at the 'knee' 73 of air condensation or pseudo-condensation at the highest pressure.

The apparatus of FIG. 10 differs from the previous one as follows.

On the one hand, all the air which is cooled under the first high pressure is expanded in turbine 46, i.e. ducts 53 are interrupted at the level of temperature T1 and the expansion valve 54 is removed.

On the other hand, an amount of air, drawn off between the two blowers 70 and 71, is cooled and liquefied in additional ducts 74 of the exchange line, until reaching the cold end of the latter, and is expanded at the mean pressure in an expansion valve 75 and sent at the base of column 50.

As a variant, as indicated by a broken line, the turbine 72 may be supplied with air which circulates in ducts 74, which are then interrupted at temperature T2. The expansion valve 75 is therefore removed, and it is the air which circulates in ducts 56 which is completely liquefied in ducts 56 and expanded at mean pressure in expansion valve 57.

Of course, it is possible to provide a combination of the two variants mentioned above.

Figure 10:
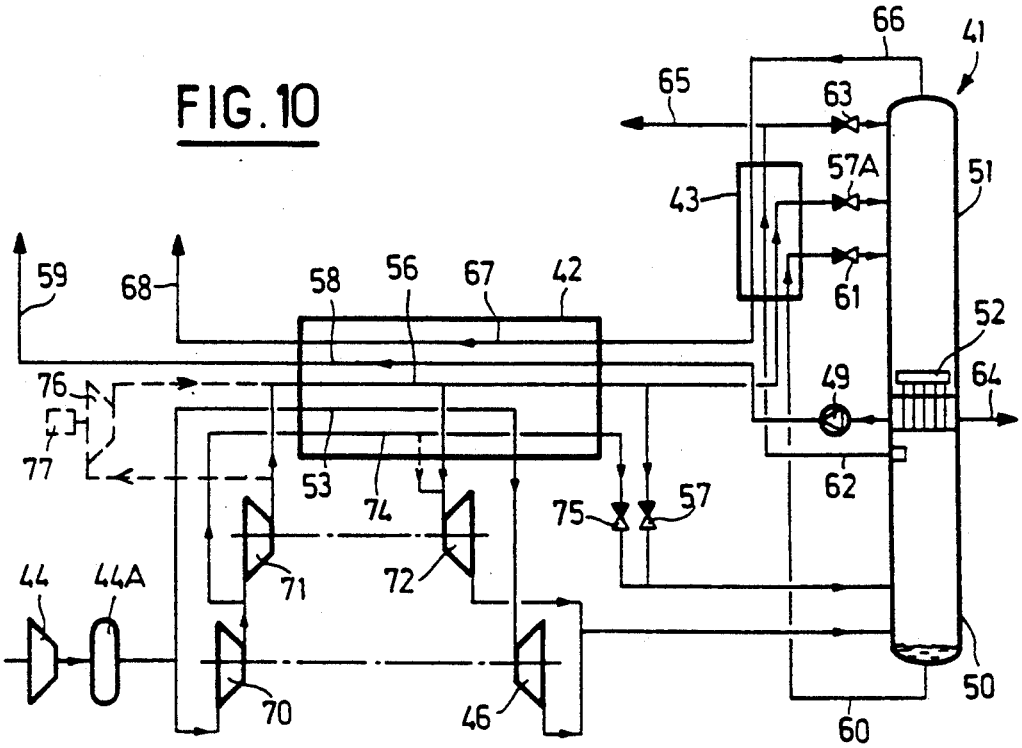
FIGS. 10 and 11 are schematic illustrations of a plurality of variants of the apparatus.

According to still another variant, as indicated by broken lines in FIG. 10, the highest air pressure may be increased further by passing the air from the blower 72 into an additional blower 76 which is operated by an electric motor 77.

Figure 11:
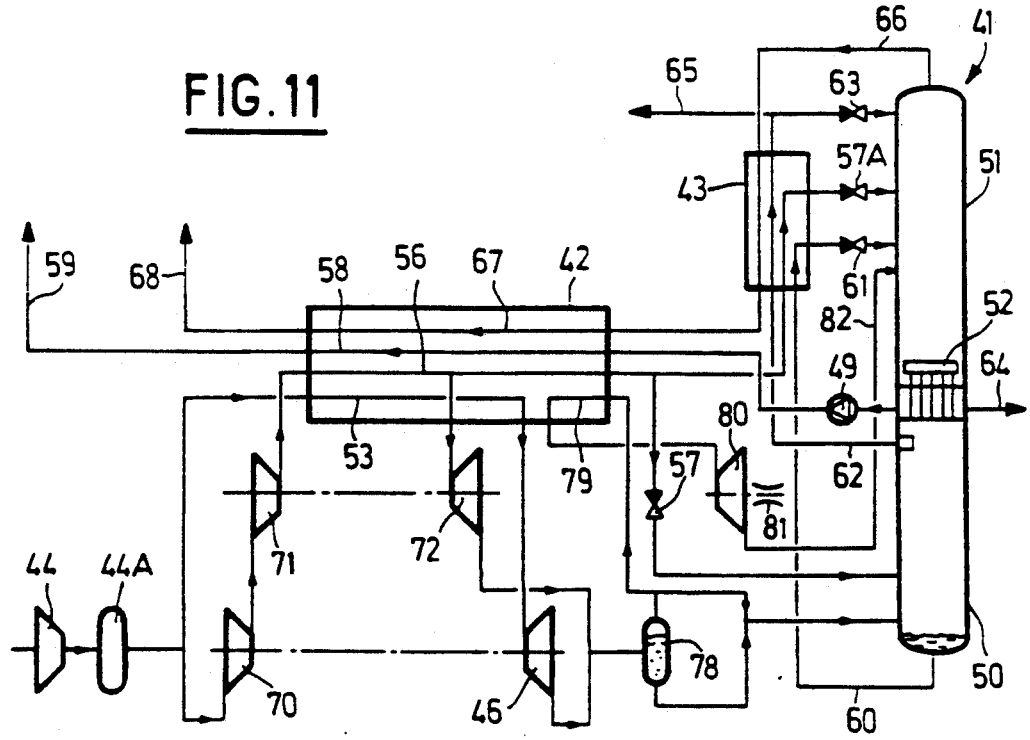

The apparatus illustrated in FIG. 11 is a variant of that of FIG. 8. It differs only in that the exhaust from the two turbines 46 and 72 arrives in a phase separator 78. The liquid and a portion of the vapor phase produced are sent to the bottom of column 50 while the remainder of the vapor phase, after partial reheating in ducts 79 of the exchange line, is expanded at lower pressure in an additional turbine 80 which is slowed down by an appropriate braking system 81. The low pressure air from turbine 80 is blown into column 51 via duct 82. This solution is applicable when the gaseous oxygen produced under pressure is of low purity (less than 99.5 percent).

I claim:

1. Process for production of gaseous oxygen at a pressure higher than approximately 13 bars by air distillation in an apparatus provided with a double column comprising a mean pressure column and a low pressure column, each of said mean and low pressure columns having a respective base and a respective pressure, said process including the steps of:

i) withdrawing liquid oxygen at the base of said low pressure column;

ii) pumping said withdrawn liquid oxygen;

iii) introducing air to be distilled into a heat exchange line, said air being at a first high pressure lower than that at which air condenses by heat exchange with said pumped liquid oxygen, where said pumped liquid oxygen is at a pressure greater than approximately 13 bars, said first pressure being at least equal to approximately 30 bars;

iv) vaporizing said pumped liquid oxygen by heat exchange with said air in said heat exchange line, to produce gaseous oxygen at a pressure higher than approximately 13 bars;

v) withdrawing a portion of said air from said line, said portion being surplus to refrigerating needs of said line;

vi) expanding said portion to the pressure of said mean pressure column at an intermediate cooling temperature in a turbine, said turbine being slowed down by a first compressor, said compressor being used in step iii) to pressurize all the air to be distilled to said first high pressure; and vii) withdrawing an amount of at least one liquid product from said apparatus as a final product.

2. Process according to claim 1, wherein for a first high pressure of approximately 30 bars, said amount of said liquid product withdrawn as a final product is approximately 25% by weight of the production of gaseous oxygen.

3. Process according to claim 1, wherein for production of gaseous oxygen at second and third pressures, respectively lower and higher than approximately 13 bars, two flows of compressed liquid oxygen are vaporized by heat exchange with compressed air at the first high pressure which is lower than that at which air condenses by heat exchange with oxygen at said third pressure during vaporization and at least equal to approximately 30 bars, and higher than that pressure at which air condenses by heat exchange with oxygen at said second pressure during vaporization.

4. Process according to claim 1, including compressing the air in first and second stages, said second stage being carried out by means of the first compressor which is operated by the turbine.

5. Process according to claim 1, including withdrawing liquid nitrogen under pressure from the double column, and vaporizing said withdrawn nitrogen, in the heat exchange line, with air at high pressure.

6. Process according to claim 1, wherein a portion of air at the pressure of the mean pressure column is, after separation of its liquid phase, expanded in a second turbine and is blown into the low pressure column.

7. Process according to claim 1, including withdrawing vat liquid from the base of the mean pressure column, expanding said liquid and introducing said liquid into said low pressure column.

8. Process for the production of gaseous oxygen at a pressure of at least approximately 13 bars, by introducing air to be distilled in an apparatus provided with a double column comprising a low pressure column and a mean pressure column, said mean pressure column having a pressure, including pumping of liquid oxygen which is withdrawn at the bottom of the low pressure column, and vaporization of the pumped liquid oxygen compressed by heat exchange with air pressurized to a high pressure which is substantially higher than the pressure of the mean pressure column, wherein said process comprises the steps of:

i) compressing all the air to be distilled to a first high pressure which is considerably higher than the pressure of the mean pressure column;

ii) cooling a first fraction of the compressed air;

iii) expanding at an intermediate cooling temperature at least a portion of said first cooled fraction to the pressure of the mean pressure column in a turbine before introducing same into the double column;

iv) boosting any remaining compressed air at the first high pressure to a second high pressure, said second high pressure being lower than at least one of (a) that pressure at which air condenses and (b) that pressure at which air pseudo-condenses, by heat exchange with oxygen vaporizing at the oxygen pressure of at least 13 bars, said second high pressure being at least equal to approximately 30 bars, and also, being selected so that one of air condensation and air pseudo-condensation at the second high pressure takes place at approximately the inlet temperature of the turbine;

v) cooling and liquefying at least a portion of the boosted air, the flow rate of which is lower than the flow rate of liquid oxygen to be vaporized;

vi) expanding said liquefied portion of air and introducing said expanded air into the double column; and vii) withdrawing at least one liquid product from the apparatus as a final product.

9. Process according to claim 8, wherein in step iv) said second high pressure is achieved by means of a blower having a compression rate lower than 2.

10. Process according to claims 9, wherein the blower is operated by means of an outside source of energy.

11. Process according to claim 8, wherein said second high pressure is achieved by means of first and second blowers mounted in series and each connected to a respective expansion turbine, each said turbine having a respective inlet temperature, the first blower being connected to a first said turbine for expanding air at the first high pressure and the second blower being connected to a second said turbine for expanding a portion of the boosted air, the inlet temperature of the second turbine being higher than that of the first turbine.

12. Process according to claim 11, comprising withdrawing a quantity of air between said first and second blowers, and at least in part cooling and liquefying said withdrawn air and, after expansion introducing said air into the double column.

13. Process according to claim 8, wherein said second high pressure is achieved by means of a blower connected to the turbine for expanding air to the first high pressure, a first portion of the boosted air being expanded in a second turbine connected to a second blower which is fed with any remaining boosted air, the air originating from the second blower being cooled and liquefied and, after expansion, being introduced into the double column.

14. Process according to claim 13, wherein the air from the second blower is again boosted by means of the third blower which is operated by means of an outside source of energy.

15. Process according to claim 14, wherein a portion of the gaseous phase of the air issued from at least one turbine is expanded at low pressure in an additional turbine, and is thereafter blown into the low pressure column.

* * * * *